US007059088B2

(12) United States Patent
Lattanzio

(10) Patent No.: US 7,059,088 B2
(45) Date of Patent: Jun. 13, 2006

(54) APPARATUS FOR SCREENING

(75) Inventor: Maurice Lattanzio, Kettleby (CA)

(73) Assignee: Spinnaker Industries Inc., Etobicoke (CA)

( * ) Notice: Subject to any disclaimer, the term of this patent is extended or adjusted under 35 U.S.C. 154(b) by 0 days.

(21) Appl. No.: 10/320,533

(22) Filed: Dec. 17, 2002

(65) Prior Publication Data

US 2004/0111982 A1 Jun. 17, 2004

(51) Int. Cl.
*E04B 1/346* (2006.01)

(52) U.S. Cl. ..... 52/64; 52/243.1; 256/25

(58) Field of Classification Search ..... 52/64, 52/243.1, 506.06; 256/24, 25; 49/413
See application file for complete search history.

(56) References Cited

U.S. PATENT DOCUMENTS

| | | | | |
|---|---|---|---|---|
| 1,181,331 | A * | 5/1916 | Metzger | 312/139.2 |
| 3,508,364 | A * | 4/1970 | Thompson | 52/126.4 |
| 3,640,559 | A * | 2/1972 | Royer | 292/288 |
| 3,708,153 | A * | 1/1973 | Triem | 256/25 |
| 4,001,985 | A | 1/1977 | Nikolaus et al. | |
| 4,263,763 | A | 4/1981 | Bouwens | |
| 4,459,790 | A * | 7/1984 | Vermillion | 52/764 |
| 4,498,262 | A | 2/1985 | Garcia | |
| 4,541,208 | A | 9/1985 | Vesperman et al. | |
| 4,962,649 | A * | 10/1990 | Battocletti | 62/256 |
| 5,664,384 | A | 9/1997 | Cullinan | |
| 6,138,993 | A * | 10/2000 | Mitchell et al. | 256/25 |
| 6,151,852 | A * | 11/2000 | Linn et al. | 52/239 |
| 6,209,271 | B1 | 4/2001 | Kovacs | |
| 6,561,493 | B1 * | 5/2003 | Lackey, Jr. | 256/73 |

FOREIGN PATENT DOCUMENTS

GB 2182085 A * 5/1987

* cited by examiner

*Primary Examiner*—Anita M. King
(74) *Attorney, Agent, or Firm*—John R.S. Orange; Sean X. Zhang; Santosh K. Chari

(57) ABSTRACT

A method and apparatus for screening faces of a substantially rectangular equipment. The apparatus having a frame structure including a plurality of screen support frames disposed around the equipment, each face having edge screen support frames laterally spaced horizontally between two vertical edges of each face such that a corner of the equipment includes edge screen support frames disposed in perpendicular relationship secured thereto, a plurality of movable screen cover panels and stationary screen cover panels supported within the screen support frame, the movable screen cover panels being slidably moved to substantially overlap the stationary cover panels to substantially expose the faces of the equipment.

20 Claims, 7 Drawing Sheets

APPARATUS FOR SCREENING

BACKGROUND OF THE INVENTION

1. Field of the Invention

The present invention relates to screening devices, more particularly it relates to a method and apparatus for screening the view of outdoor equipment.

2. Description of the Prior Art

Large equipment, such as high voltage air conditioning units, heating, and ventilating equipment are often placed on top of buildings to increase the interior volume without increasing the overall height of the structure. However, this arrangement can be unsightly and thus it is necessary or desirable to improve its appearance and make it aesthetically pleasing, especially in public spaces some form of screening apparatus is used but generally, the screening apparatus for large equipment can be difficult and time consuming to install or remove when it is necessary to make repairs or adjustments.

Several solutions have been proposed by the prior art, for example, U.S. Pat. No. 5,664,384, describes a device which provides a cover for large outdoor equipment, such as ventilation equipment. The cover panels used within the device have to be removed from the frame before workers may gain access to the equipment for repair. This introduces a safety hazard when working at elevated locations. In another embodiment, the entire frame may be flipped up, in a similar manner to a hood of a car being opened, so that a worker may gain access to the equipment. Again, however, this restricts access and exposes a large surface area to wind and the like.

None of the prior art appears to show a screening device supported by outriggers as to be spaced from the unit with panels that are slidable along tracks to permit access to the unit.

SUMMARY OF THE INVENTION

A screening device for screening roof mounted equipment and the device having a frame structure to extend across at least one face of the equipment. A pair of support frames laterally placed along the one face and extending between the equipment and the frame to support the frame in spaced relationship from the equipment. A plurality of panels located on the frame, at least one of the panels being slidable relative to the frame between a first position in which a portion of the face is covered and a second position in which the portion of the face is exposed.

A screening device for screening roof mounted equipment comprising a frame having a plurality of panels with at least one of the panels moveable from a position in which a portion of a face of the equipment is covered to a position in which it is uncovered. A pair of support frames for supporting the frame is spaced in relationship from the face of the equipment. Each of the support frames being fastened directly to the equipment so as to cantilever the frame therefrom.

BRIEF DESCRIPTION OF THE DRAWINGS

These and other features of the preferred embodiments of the invention will become more apparent in the following detailed description in which reference is made to the appended drawings wherein.

DESCRIPTION OF THE PREFERRED EMBODIMENTS

Figure 1:
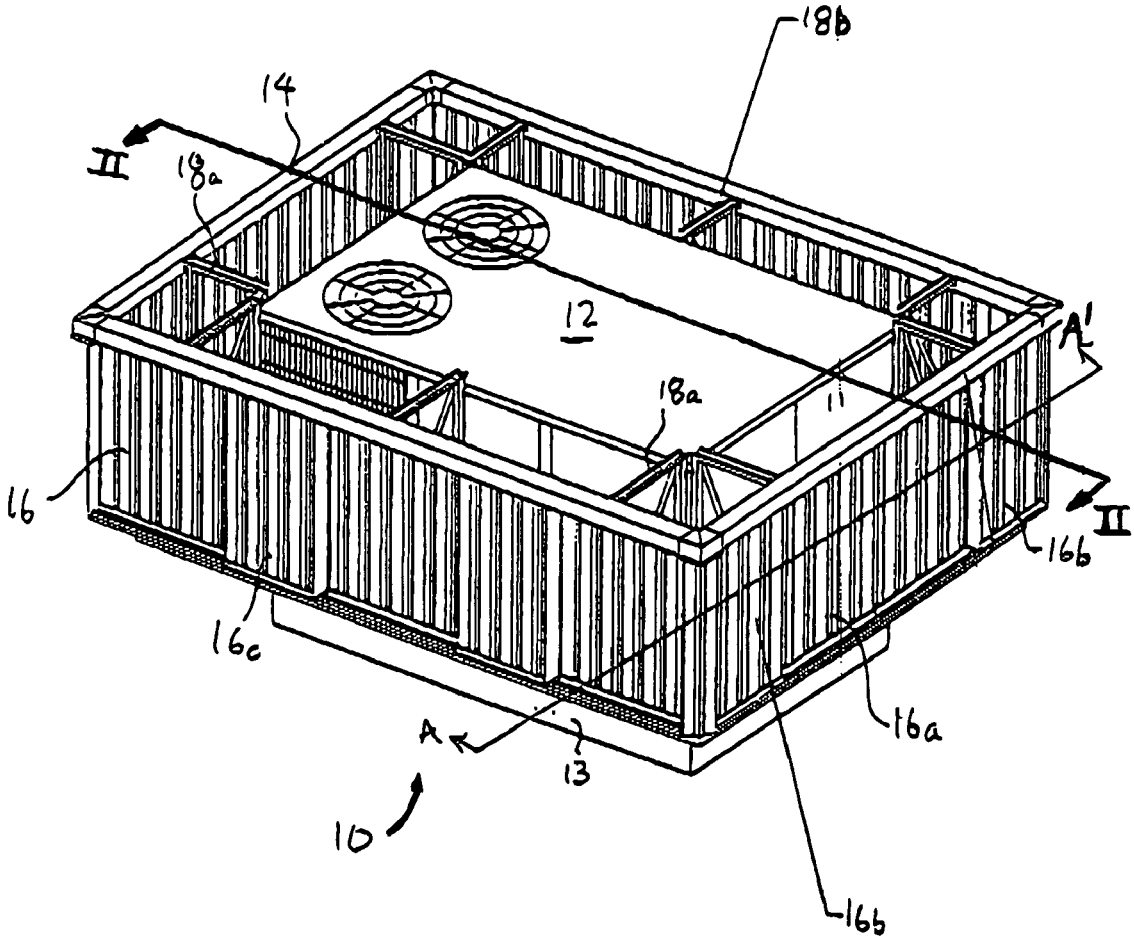
FIG. 1 shows a screen in use with an equipment.

Reference is first made to FIG. 1 of the drawings representing a screening device 10 secured to equipment 12, such as a high voltage air conditioning unit and having external faces 11. Generally, the equipment 12 is located on top of a roof 13 of a building. The screening device 20 includes a frame structure 14 having a plurality of screen cover panels 16 disposed therein. The screen cover panels 16 serve to screen the equipment 12, and are disposed a predetermined distance from the equipment 12 sufficient to permit access to the equipment. The panels 16 are either moveable panels 16*a*, fixed corner panels 16*b* or fixed intermediate panels 16*c* whose position is determined by the nature of the equipment being screened.

Figure 2:
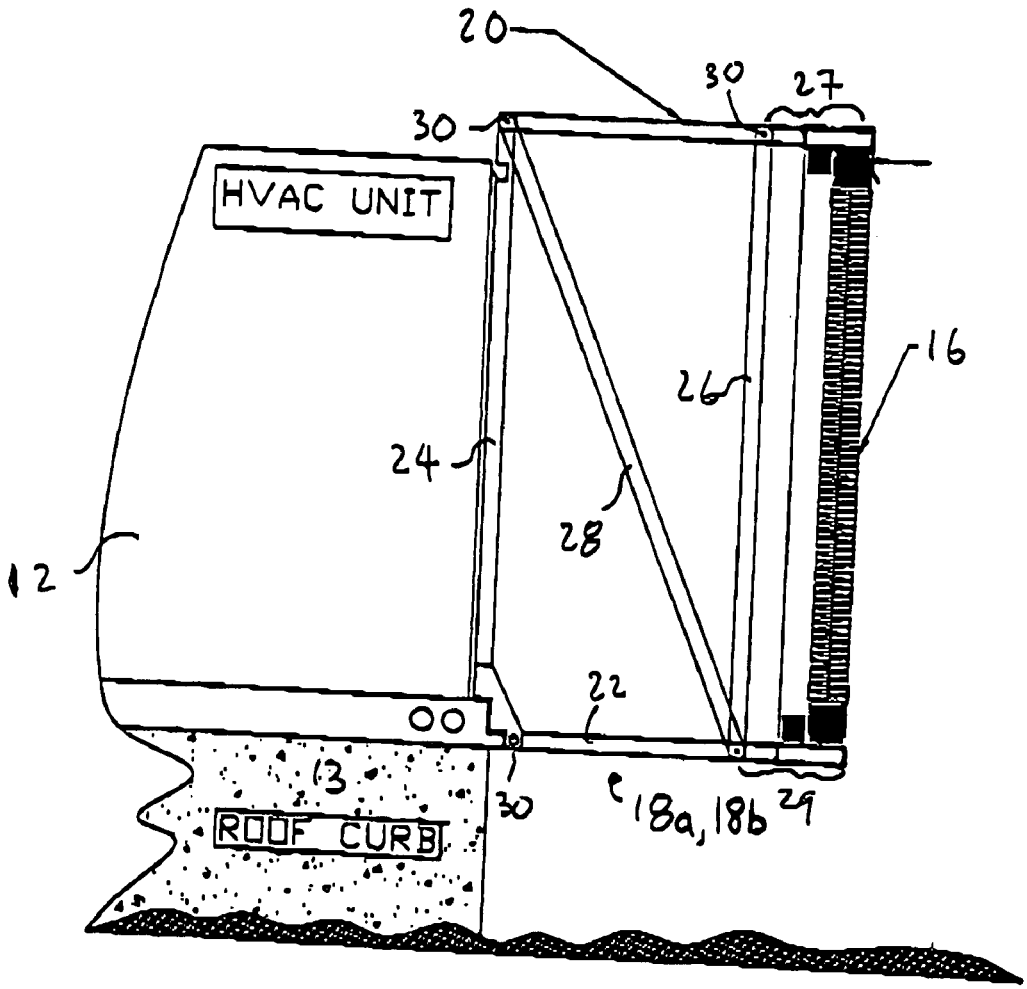
FIG. 2 is a section view along II—II of FIG. 1.
Figure 3:
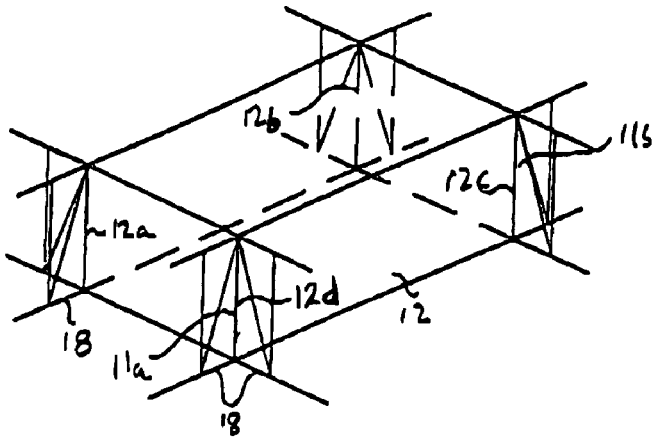
FIG. 3 is a schematic representation of the placement of support frames on the equipment shown on FIG. 1.
Figure 4:
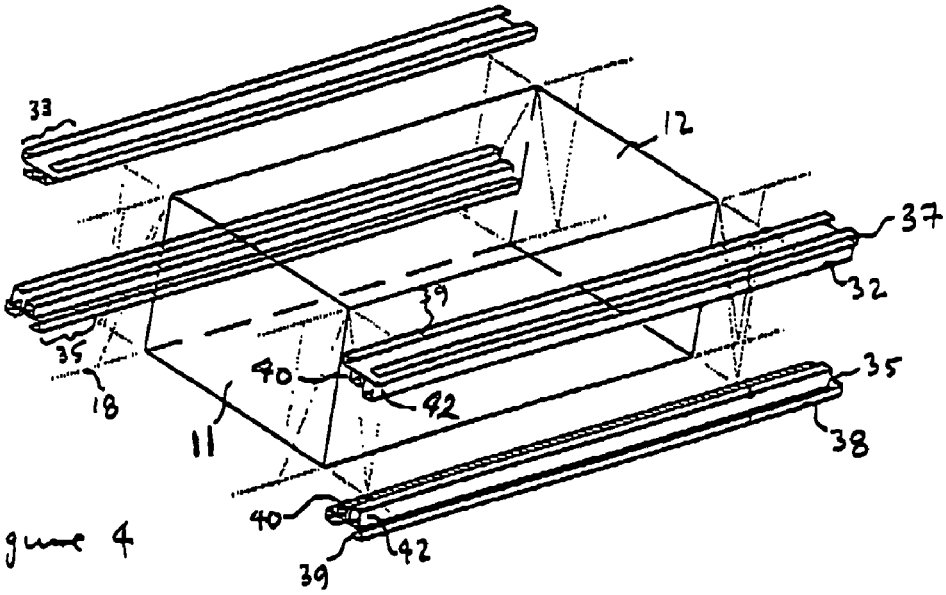
FIG. 4 is a perspective view of the placement of tracks on the support frames of FIG. 3.
Figure 5:
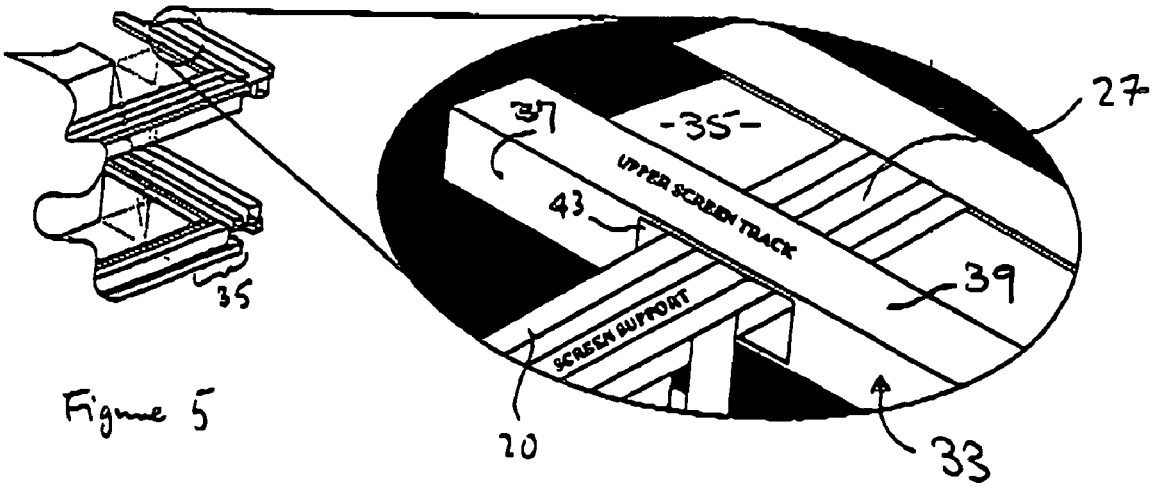
FIG. 5 is an exploded view of the engagement of a upper screen rack with a cantilever arm of the screen support frame.
Figure 6:
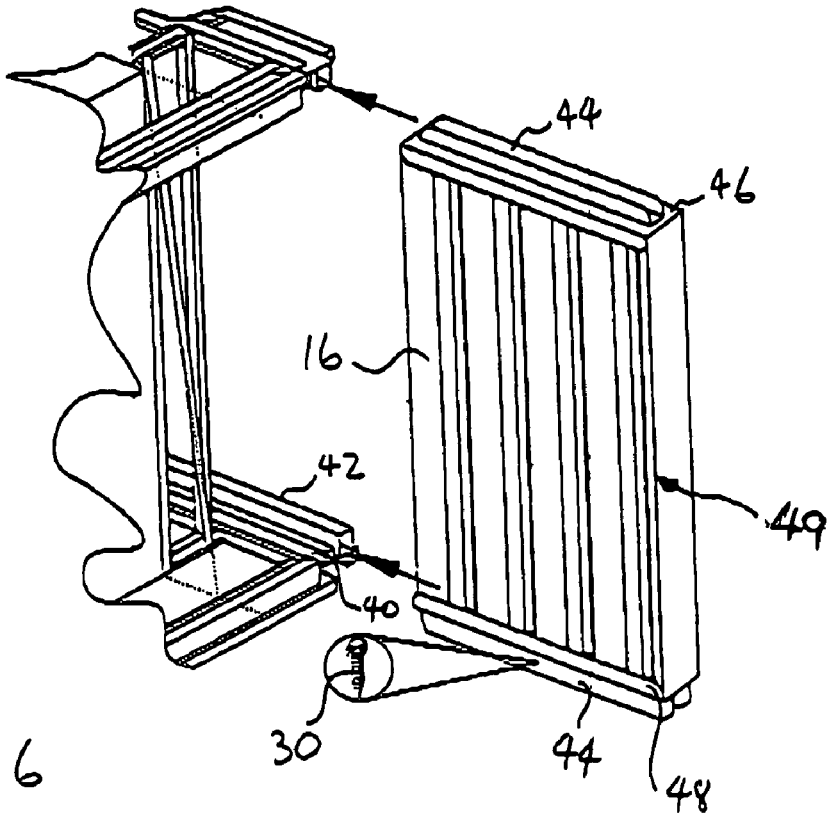
FIG. 6 is an exploded view, showing attachment of a portion of the screen to the tracks of FIG. 4 of the slidable engagement between tracks and the screen cover panel.
Figure 7:
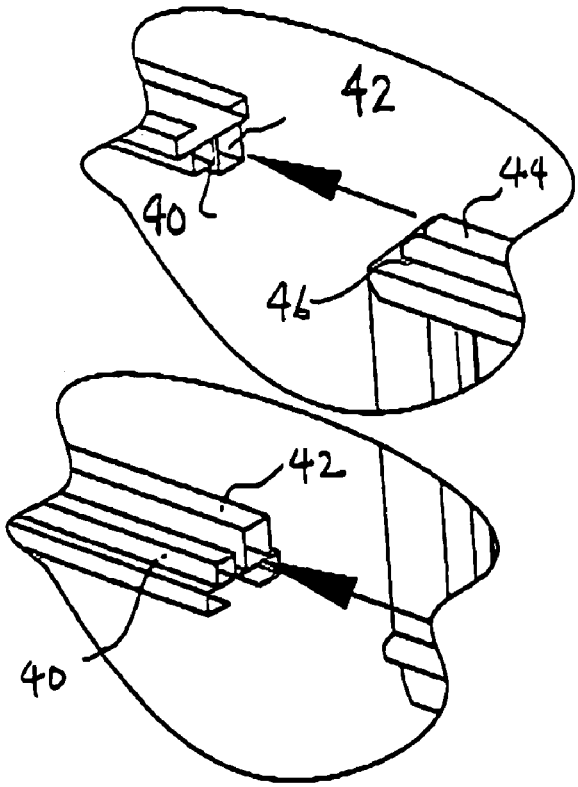
FIG. 7 is an enlargement view similar to FIG. 6 exploded view of a tongue and groove configuration between rails and guides.

Referring to FIG. 2, the frame structure 14 is cantilevered from the equipment 12 by a plurality of screen support frames 18 disposed around the equipment 12. A screen support frame 18*a* is disposed at each corner and an intermediate support frames 18*b* disposed between the edge screen support frames 18*a*, if required. Each screen support frame 18 includes an upper cantilever arm 20 and a lower cantilever arm 22 arranged substantially parallel to one another. An inner column 24 is secured between the inner ends of upper cantilever and 20 the lower cantilever arm 22 and is adapted for attachment to the equipment 12. An outer column 26 extends between the outer ends of the upper cantilevered arm 20 and the lower cantilevered arm 22 parallel to the inner column 24. A portion of the cantilever arms 20, 22 projects beyond the outer column 26 to define an upper lip 27 and a lower lip 29. The screen support frame 18 also includes a bracing member 28 disposed diagonally between the first cantilever arm 20 and the second cantilever arm 22. The bracing member 28 conveniently is secured to each of the arms 20, 22 at the attachment of the columns 24, 26. Typically, the cantilever arms 20, 22, the inner and outer columns 24, 26, and the bracing member 28 are formed as hollow tubes having a generally rectangular cross section.

The inner column 24, the outer column 26, the bracing member 28, and the cantilever arms 20, 22 are held together by fasteners 30, such as nuts and bolts, welding, rivets and so on. The screen support frames 18 are preassembled, although the fasteners 30 may be loose to assist in alignment during installation. The inner column 24 is bolted to an outer surface of the equipment 12 so as to beheld above the surface of the roof and avoid penetration of the roof. The frame 14 is thus cantilevered from the equipment 12 and maintained elevated from the roof.

Referring to FIGS. 3, 4, 5, 6 and 7, the frame structures 14 are supported between the upper lip 27 and the lower lip 29 to maintain the panels 16 at the distance of the cantilever arms 20, 22 from the equipment 12 at predetermined distances around the equipment 12. The plurality of screen cover panels 16 are appropriately arranged to shield the equipment 12, while at the same time providing a screen 10 which has desirable aesthetics.

The screen cover panels 16 are supported by an upper track 32 and lower track 38 of the frame structure 14. Each of the tracks 32, 38 has an inner rail 40 and an outer rail 42 secured thereto. Each of the tracks 32, 38 is formed from a reentrant channel member 33 with a base 35 and sidewalls 37. End walls 39 extend from the sidewalls 37 parallel to the base 35. The rails 40, 42 are secured to the base 35 opposite to the walls 37 and each are square in cross section.

Figure 8:
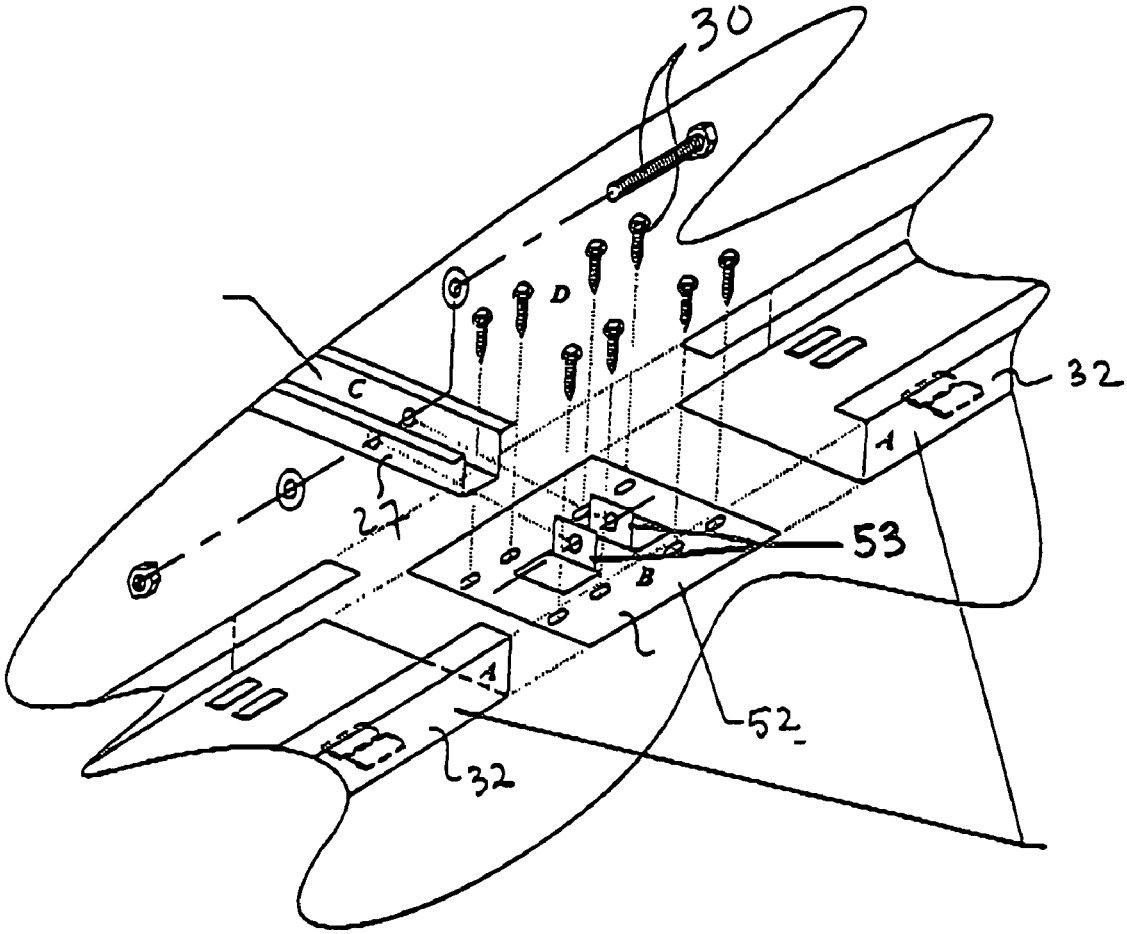
FIG. 8 is an exploded view of the interconnection of rail members with support members.

The upper track 32 and the lower track are secured to the upper lip 21 and the lower lip. 29 of the support frames structures respectively by apertures 43 in the side walls 37 and between the end walls 39 and base 35. The upper track 32 and the lower track 38 extend longitudinally between edge screen support frames 18*a*, and extend substantially beyond both edge screen support frames 18*a* such that a portion of the upper track 32 and the lower track 38 at either end extends laterally beyond the face 11 of the equipment 12. The tracks 32, 38 can be joined end to end to increase the length of the frame 14 by a joiner plate 52 connected between the pair of tracks 32, 38, as shown in FIG. 8. The plate 52 is generally planar and has a pair of upstanding tags 53. The tags 53 are spaced apart to receive the outer end of the arms 20, 22 of a frame 18 positioned at the connection of the tracks. The plate 52 is dimensioned to slide into the base and secured with tags 55 engaging in the apertures in the plate 52. The sidewalls 35 of the upper track 32 and the lower track 38 include apertures 43 to accommodate the upper lip 27 and the lower lip 29, such that each of the tracks is supported on a respective one of the upper lip 27 or lower lip 29. The apertures 43 are dimensioned such that the lips 27, 29 are held snugly within the lips 27, 29 and may be secured by a screw or bolt. The tracks 32, 38 are thus separated in vertical alignment with the rails 34, 36 facing one another.

The inner rails 40 are generally smaller in dimension than the outer rails, 42 and the rails are spaced from each other to provide a slot in order to accommodate the screen cover panels 16.

The screen cover panels 16 include U-shaped channel guides 44 disposed lengthwise on an upper edge 46 and a lower edge 48 of an outer frame 49. The U-shaped channels 44 are dimensioned to slidably engage either the outer rails 42 or the inner rails 40 to allow displacement of the screen cover panel 16 along the tracks 32, 38. The screen cover panels 16 are assembled within the frame structure 14 by sliding the screen cover panels 16 between the tracks 32, 38 such that the U-shaped channels 44 fit around respective ones of the rails 40 and 42. Where the screen cover panels 16*a* are to be moveable they are supported on smaller inner rails 40, while the stationary screen cover panels 16*b* are disposed on outer rails 42 with a closer fit and fastened in situ by a screw 30.

The arrangement of sliding and fixed panels is determined by the nature of the equipment being shielded. Sliding panels are installed where access is required and stationary panels installed at other locations to add rigidity. As can been seen in FIG. 2, intermediate stationary screen cover panels 16*c* are located between the edge stationary screen cover panels 16*b*, depending on the dimensions of the equipment 12. The stationary screen cover panels 16*b* are generally located at corners 12*a*, 12*b*, 12*c*, 12*d* of the frame structure 14 and are fastened to the upper track 32 and the lower track 38, so as to add rigidity to the overall frame structure 14. However, stationary panels may be inserted between the ends as shown at 16*c*.

Figure 9:
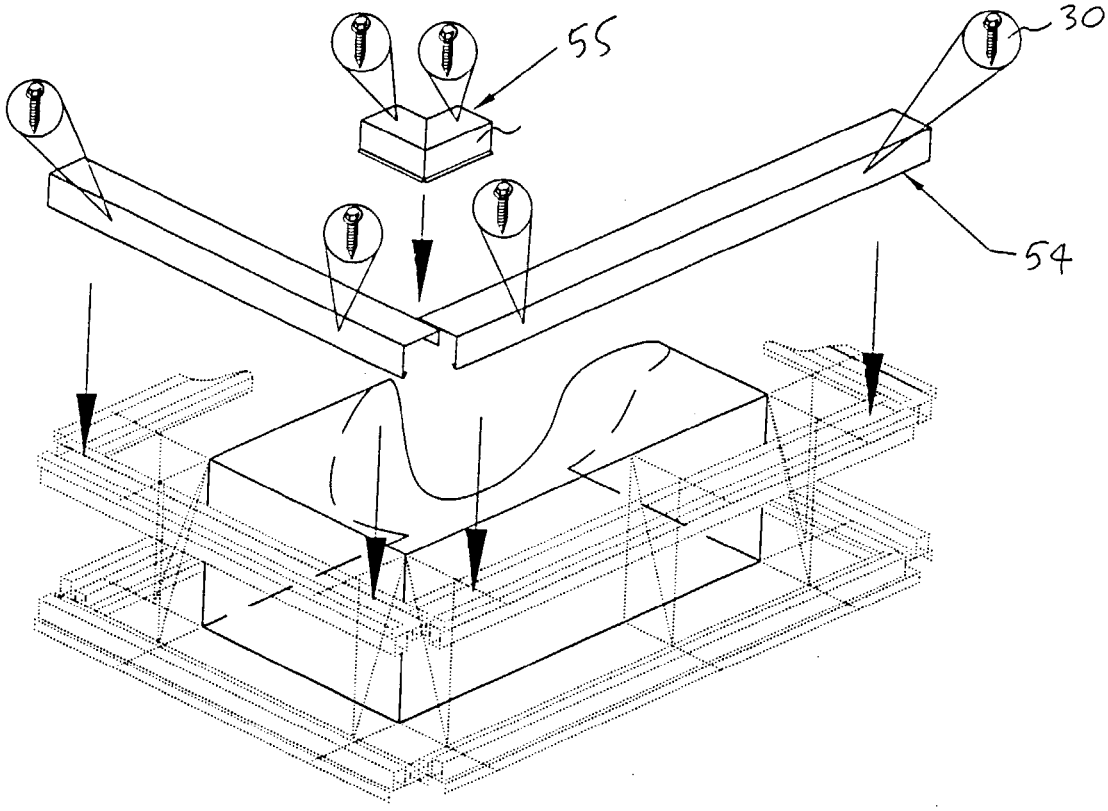
FIG. 9 shows positioning of a corner cap and a top cap.
Figure 10:
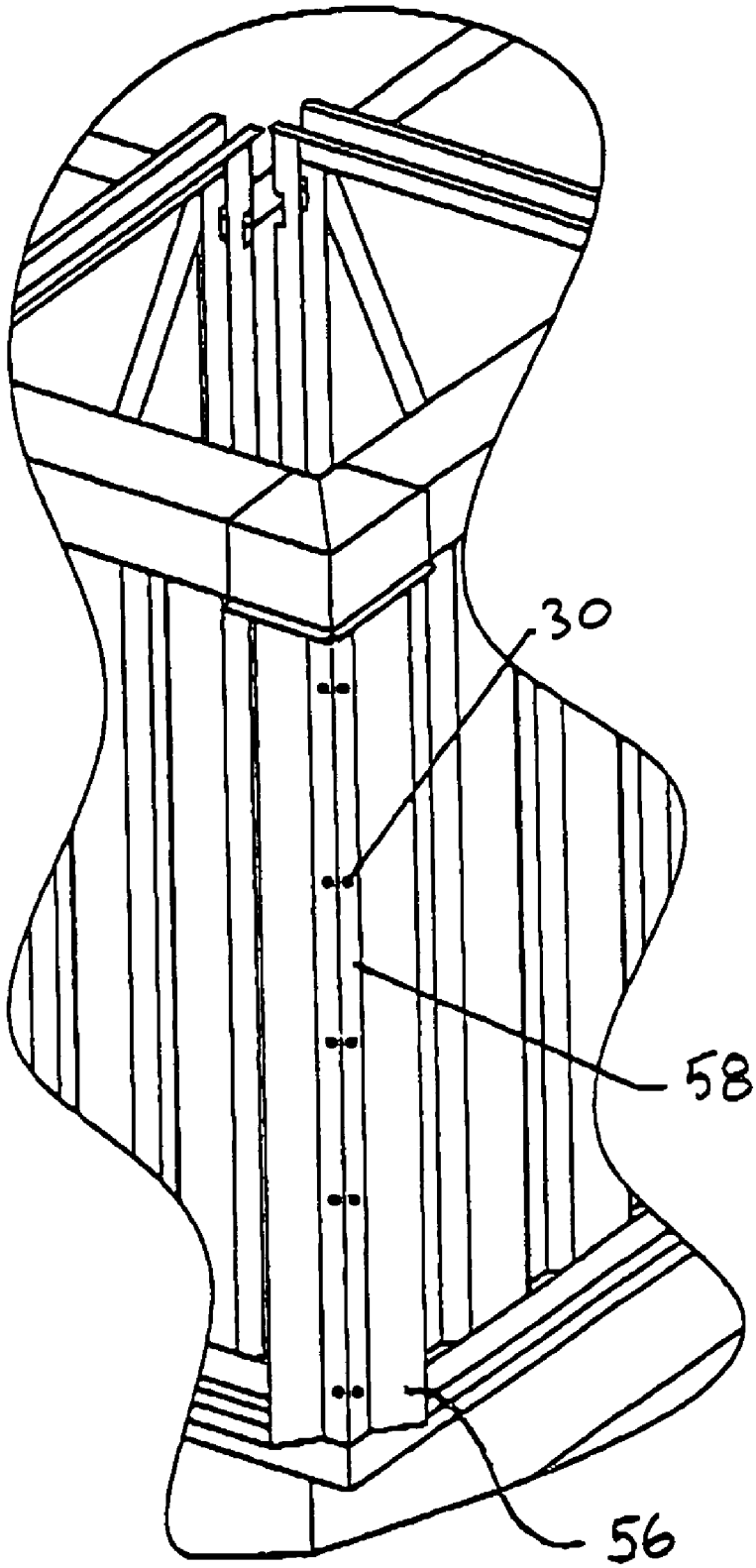
FIG. 10 shows positioning of a corner angle/gap cover.

Referring now to FIGS. 9 and 10, a top cap is secured on top of the upper track 32 by a fastener 30. Generally, the top cap 54 is dimensioned to fit upper track 32 and extend the longitudinal length of the upper track 32. The top cap 54 can be joined or cut to match the length of the upper track 32. The stationary screen cover panels 16*b* that are adjacent one another are covered by an angle cap 56 to cover the adjacent edges and prevent removal of the sliding panels 16*a*.

In use, the sliding panels 16*a* are slidable along the inner tracks to expose selected locations of the equipment. The panels 16*a* are retained securely in the tracks while being slidable to provide access. A uniform aesthetic appearance is provided to the exterior.

Reference is now made to FIG. 2 and FIGS. 1, 3–10, in order to describe a method of assembly of the screen device 10.

Initially the site is prepared for installation by taking measurements of the faces 11 of the equipment 12 to determine the number of screen support frames 18 that are needed for placement around the equipment 12 and the placement of the fixed and sliding panels.

The screen support frames 18 are positioned and secured at each comer 12*a*, 12*b*, 12*c*, 12*d* of the generally rectangular equipment 12, such that each face 11 of the equipment 12 has at least two screen support frames 18 laterally spaced horizontally between the two vertical edges 11*a*, 11*b* of the faces 11.

When intermediate screen support frames 18*b* are needed depending on the dimensions of the equipment face 11 they are attached at appropriate locations that permit attachments on the equipment.

If longer tracks are needed, a joiner plate 52 is inserted into a pair of tracks 32, 38 in order to lengthen the tracks 32, 38 to accommodate the dimensions of the equipment 12. The joiner plate 52 is fastened to the upper lip 27 and lower lip 29 of an intermediate screen support frame 18.

The upper track 32 is slid into the upper lip 27 of screen support frames 18, by aligning the apertures 43 defined in the upper track 32 with upper lip 27 of the screen support frames 18.

Similarly, the lower track 38 is slid into the lower lip 29 of screen support frames 18, by aligning the apertures 43 defined in the lower track 38 with lower lip 29 of the screen support frames 18.

The upper track 32 and lower track 38 are secured onto lips 27, 29, respectively, with a fastener 30.

The movable screen cover panels 16a are slid between the tracks 32, 38 such that the U-shaped channels 44 pass to either side of the inner rails 40.

The stationary screen cover panels 16b are slid between the tracks 32, 38 such that the U-shaped channels 44 engage the outer rail 42.

The stationary screens 16 are located at the selected locations such as comers 12*a*, 12*b*, 12*c*, 12*d* of the frame structure 14 and fastened to the upper track 32 and lower track 38, such so as to add rigidity to the overall frame structure 14. The stationary screen cover panels 16*b* are outside the footprint of the equipment face 11 and so disposed to allow access to the equipment face 11. The moveable screen cover panels 16*a* are slidable along the tracks as to be able to overlap the stationary screen cover panels 16*b*.

A top cap 54 is positioned and secured on the upper track 32 and a comer cap 55 secured at an intersection of the top caps 54, and a comer angle/gap cover 58 is then attached between perpendicular stationary screen cover panels 18 at corners 12*a*, 12*b*, 12*c*, 12*d*.

In an example of a screening device 10 installation, the inner surface of the frame structure 14 is approximately 18 inches from the equipment 12, and the thickness of the fame is approximately 4 inches. Thus this gap between the screen cover panels 16 and the equipment 12 allows for installation of input or output services to the equipment 12, such as, gas lines, water/waste discharge pipes or power utility boxes.

In yet another embodiment, there is provided only one rail 34, 40 for the slidable motion of the movable screen cover panels 16*a*, while the stationary screen cover panels 18 are fixedly secured to the screen frame structure 18 and do not rest on any rail.

Although the invention has been described with reference to certain specific embodiments, various modifications thereof will be apparent to those skilled in the art without departing from the spirit and scope of the invention as outlined in the claims appended hereto.

The embodiments of the invention in which an exclusive property or privilege is claimed are defined as follows:

1. A building having a roof with equipment mounted thereon to supply services to said building, and a screening device for screening said equipment, said device having a frame structure to extend across at least one face of said equipment, a pair of support frames laterally spaced along said at least one face and each extending generally normal to said frame structure to maintain said frame structure in spaced relationship from said at least one face of said equipment, said support frames being connected at one end to said frame structure and connected at an opposite end to said equipment and each of said support frames being operable to inhibit relative vertical movement between said ends to maintain a lower edge of said frame structure elevated from said roof when said opposite end is supported on said equipment, a plurality of panels located on said frame structure, at least one of said panels being slidable relative to said frame structure between a first position in which a portion of said at least one face is covered and a second position in which said portion of said at least one face is exposed.

2. A building according to claim 1 in which another of said panels is secured to said frame structure to inhibit relative movement there between.

3. A building according to claim 2 wherein said frame structure includes an upper track and a lower track and said one panel is slidable on rails on each of said tracks.

4. A building according to claim 3 wherein each of said support frames include upper and lower frame members engaged with said upper and lower tracks respectively to provide support therefore.

5. A building according to claim 4 wherein distal ends of said upper and lower frame members are received in apertures in said tracks.

6. A building according to claim 4 wherein said upper and lower frame members of each support frame are maintained in spaced relationship by a pair of columns.

7. A building according to claim 6 wherein one of said columns is adapted to be secured to said at least one face of said equipment.

8. A building according to claim 7 wherein distal ends of said upper and lower frame members extend beyond the other of columns and are received in apertures in said track.

9. A building according to claim 8 wherein a brace extends between said upper and lower frame members.

10. A building according to claim 3 wherein each of said tracks includes a pair of rails arranged side by side and said panels are mounted on different ones of said rails to permit said one panel to slide past the other of said panels.

11. A building according to claim 10 wherein said one panel is located on a rail adapted to be positioned closest to said equipment.

12. A building according to claim 2 wherein said other of said panels is located at one end of said frame structure.

13. A building according to claim 3 wherein said tracks are formed from a pair of track members connected end to end by a bracket and a further support frame is located at the connection to provide support for said bracket.

14. A building according to claim 13 wherein said bracket includes a pair of upstanding flanges for engagement with upper and lower frame members of said support frame.

15. A screening device for screening equipment mounted on a roof comprising a frame structure having a pair of tracks and plurality of panels with at least one of said panels moveable along said tracks from a position in which a portion of a face of said equipment is covered to a position in which it is uncovered, a pair of support frames for supporting said frame structure in spaced relationship from said face of said equipment, each of said support frames having a first end connected to said frame structure and a second end being adapted to be fastened directly to said equipment, said support frame inter-connecting said ends to inhibit relative vertical movement between said first end and said second end of said support frames and permit said second end to support said first end when said second end is connected to said equipment, each of said support frames having upper and lower attachments to connect to respective ones of said tracks so as to cantilever said frame structure therefrom.

16. A screening device according to claim 15 in which each of said support frames includes a pair of vertical columns, one of said columns being adapted to be secured to a vertical surface of said equipment.

17. A screening device according to claim 16 wherein said pair of tracks are vertically spaced from one another, a lower of said tracks being elevated from said roof by said support frame when said support frame is attached to said equipment.

18. A screening device according to claim 17 wherein said support frame includes a brace extending diagonally between said columns.

19. A screening device according to claim 15 wherein said one panel slides relative to said frame structure to uncover said one portion of said face.

20. A screening device according to claim 19 wherein the other of said panels is fixed.

* * * * *